United States Patent [19]

Fegley

[11] 3,930,597

[45] *Jan. 6, 1976

[54] CHEMICAL DISPENSING ANTI-BURGLARY DEVICE

[76] Inventor: Charles Robert Fegley, 1606 Frush Valley Road, Laureldale, Pa. 19605

[ * ] Notice: The portion of the term of this patent subsequent to Apr. 23, 1991, has been disclaimed.

[22] Filed: Mar. 20, 1974

[21] Appl. No.: 452,820

[52] U.S. Cl. ..... 222/83.5

[51] Int. Cl.[2] ..... B67B 7/28

[58] Field of Search ..... 222/5, 83.5, 162, 180, 222/182, 173; 9/314–320; 42/1 G

[56] References Cited

UNITED STATES PATENTS 3,806,000 4/1974 Fegley ..... 222/180

FOREIGN PATENTS OR APPLICATIONS 555,233 1/1957 Italy ..... 9/316

*Primary Examiner*—Stanley H. Tollberg
*Assistant Examiner*—Norman L. Stack, Jr.

[57] ABSTRACT

A chemical dispensing anti-burglary device is disclosed in which a chemical irritant such as tear gas is discharged into the area to be protected when an intruder opens a window or a door or forces open a window or a door to enter a private or unauthorized area with which the device is associated. The anti-burglary device employs a spring biased firing member for discharging a chemical irritant from a pressurized container. An improved means for releasably retaining the firing member in a cocked position and improved mechanical and electromechanical means for releasing the chemical irritant are described.

17 Claims, 33 Drawing Figures

Section B-B

Section A-A

Section B-B

Section B-B

Section H-H

Section B-B

Section B-B

Section J-J

Section J-J

Section G-G

Section C-C

Section D-D

Section G-G

Section D-D

Section E-E

Section E-E

Section H-H

Section F-F

Section K-K

Section M-M

Section L-L

CHEMICAL DISPENSING ANTI-BURGLARY DEVICE

BACKGROUND OF THE INVENTION

The invention relates generally to an anti-burglary device and more particularly to an anti-burglary device which discharges a chemical irritant such as tear gas from a pressurized container, one type of which is an aerosol container, into a protected area upon activation by an unauthorized person, causing the protected area to be flooded with a chemical irritant and forcing evacuation of the protected area by the intruder; but the invention is not limited to the use of the aerosol type container.

Chemical weapons have been known in the art for many years. One type of chemical weapon is the conventional tear gas grenade in which the firing member is generally triggered manually and the grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglary device discharges an explosive tear gas shell into the area but this type is both dangerous and very limited as to the amount of tear gas which is discharged into the area to be protected.

Thus what is needed is an anti-burglary device in the form of a chemical irritant dispenser which can be fired by a relatively small amount of mechanical force even though the chemical weapon employs a relatively heavy spring for actuating the dispensing means of the pressurized chemical irritant container with sufficient force to release the irritant from the pressurized container but which anti-burglary device is positively secured against accidental release until triggered by an intruder and which will then release a sufficient volume of chemical irritant into the protected area to force evacuation by the intruder.

SUMMARY OF THE INVENTION

The principle object of the present invention is to provide an anti-burglary device of the chemical irritant dispensing type which may be triggered directly by a small amount of mechanical movement, and yet is positively secured against accidental release.

A further object of the invention is to provide an anti-burglary device of the chemical weapon type which is readily triggered by opening a door, window, or ceiling skylight by an intruder entering an unauthorized area or by moving an object with which the device is connected.

Another object of the invention is to provide an improved means of spraying or discharging the chemical irritant into the protected area in a minimum amount of time in order to force the intruder from the protected area and to prevent the intruder from re-entering the protected area for a reasonable amount of time.

A further object of the invention is to provide an anti-burglary device having means for reloading the device and resetting the firing member of the weapon in its cocked position after the device has been triggered.

Another object of the present invention is to provide a directable emission of the irritant means, such as by means of rotatably adjustable spray head, so that the invention might be located on a door, wall, or the like, and yet, when the device is discharged, the chemical irritant is directed into the area to be protected.

According to the principle aspect of the present invention there is provided an improved means for releasably retaining a spring biased firing member of the anti-burglary device in its cocked position. Such means includes a trigger element adapted to be movably mounted in an actuation position and in a release position. A cord, cable, wire or the like, connects the trigger element to a window, door or other object which might be moved by an unauthorized person entering a room or building, or across a walkway or other area from which it is desired to restrict unauthorized persons. When the trigger element is in its actuation position, it retains a firing member in a cocked position. When the door or window associated with the device is opened by an unauthorized person, or when the object is moved by an unauthorized person or when the person enters the restricted area, the cord connected to the trigger element moves the latter from engagement to a release position; thereby releasing and permitting the firing member to be thrust toward the chemical weapon in the device by the force of the spring associated with the firing member and causing the chemical irritant to be discharged into the protected area.

Since the trigger element which serves to retain the firing member in its cocked position is movable, a relatively small amount of force is required to move the trigger element in the body member and to position the trigger element in engagement with the other members. Even more important, a relatively small amount of force is required to move the trigger element to discharge the chemical weapon, even though a relatively strong spring is employed for forcing the firing member toward the chemical weapon. As a consequence, the cord connected to the trigger element in the present invention will not break in triggering the chemical weapon. The resistance to movement of the cord due to its connection to the trigger element is sufficiently low as as not to be observed by an intruder. Nevertheless, the trigger element serves to retain the firing member safely in its cocked position against accidental release.

Alternatively, the chemical dispensing anti-burglary device may be connected to an electric circuit to effect discharge when the electric circuit is completed. The device may, therefore, be used in existing anti-intrusion or anti-burglary systems or may be connected by a switch and a power source. Upon energization, an electromechanical actuation releases the firing member and causes the pressurized container to discharge its contents.

An additional method of retaining the trigger element is to control the trigger element with a fusible link such that the trigger element is held in position until an electric current is passed through the fusible link, thus releasing the firing member and causing the pressurized container to discharge the chemical irritant.

The anti-burglary device of the chemical weapon type of the present invention may be utilized in homes, factories, farms, office buildings by attaching the device to doors, windows, sky-lights, etc. and may be used in connection with vehicles such as automobiles, boats, trucks, airplanes, etc. The device may also be employed for any other application wherein it is desired to prevent unauthorized persons from moving certain objects by placing the mounted device against any other wall or object to prevent the unlocked device from firing until unauthorized movement of the subject objects.

Once actuated, the spray cannot be turned off by the intruder and the entire amount of pressurized chemical irritant will be discharged into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 1:
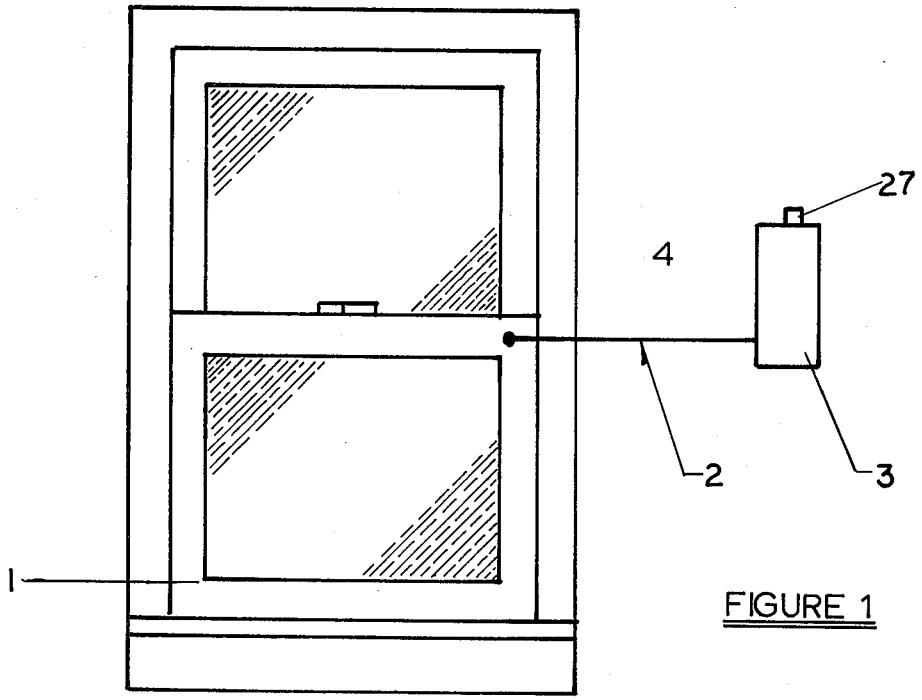
FIG. 1 is an elevational view of a wall of a room having one embodiment of the chemical dispensing anti-burglar device of the present invention secured to the wall and connected by means of a cord to the sash of a window in the wall.
Figure 2:
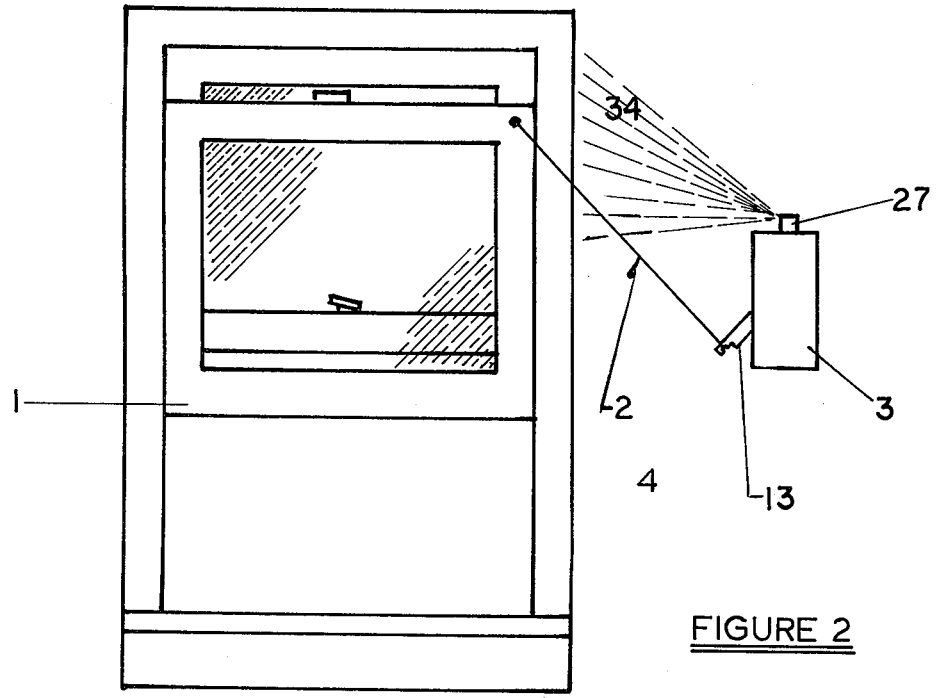
FIG. 2 is an elevational similar to FIG. 1, but showing the window open and showing the device discharging.
Figure 3:
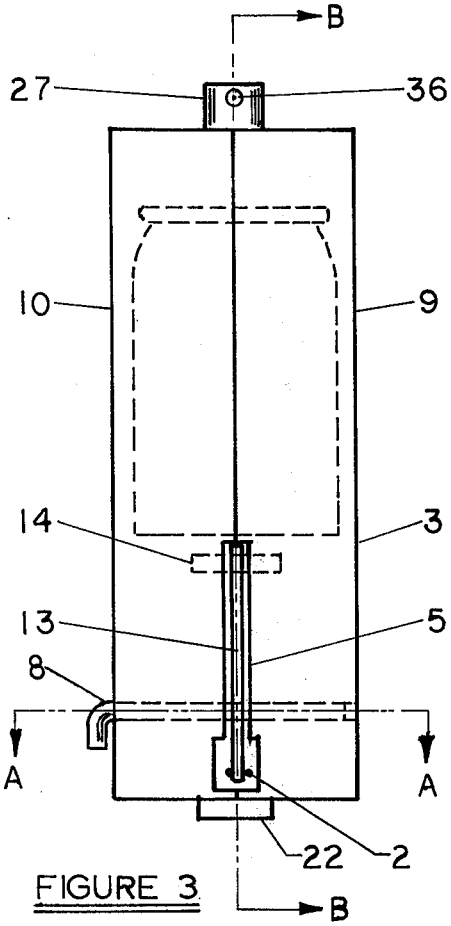
FIG. 3 is a front elevational view of the chemical dispensing anti-burglar device.

Referring now to the drawings in detail, wherein like reference characters designate like parts throughout the various views, there is shown in FIGS. 1–6, one form of the chemical dispensing anti-burglar device, called device hereafter, of the chemical weapon type according to the present invention, generally designated 3. The device 3 is secured to a wall 4 and connected by means of a cord 2 to a window sash 1 in the wall 4 so that upon opening of the window sash 1 by a burglar or other intruder, the device 3 will be actuated to discharge a chemical irritant 34 into the restricted area. The device 3 whose front is shown in FIG. 3 comprises of a pressurized chemical irritant container 11, called pressurized container hereafter supported in a body member. One type of body member is shown as a housing containing. a right housing half 9 and a left housing half 10. The housing halves 9 and 10 when assembled provide three flat sides, other than the front, for mounting the device 3 to the wall 4 adjacent to the window sash 1 or elsewhere, as may be convenient.

Figure 6:
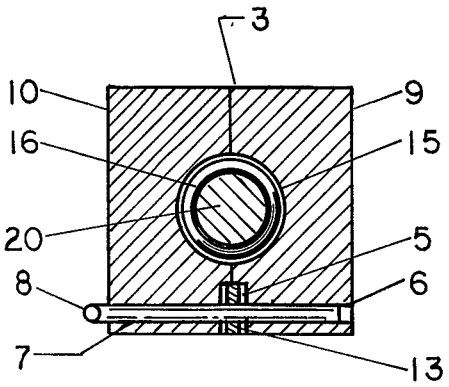
FIG. 6 is a partial horizontal section taken along line A—A of FIG. 3 with the lever cocked and locked by the safety pin.
Figure 4:
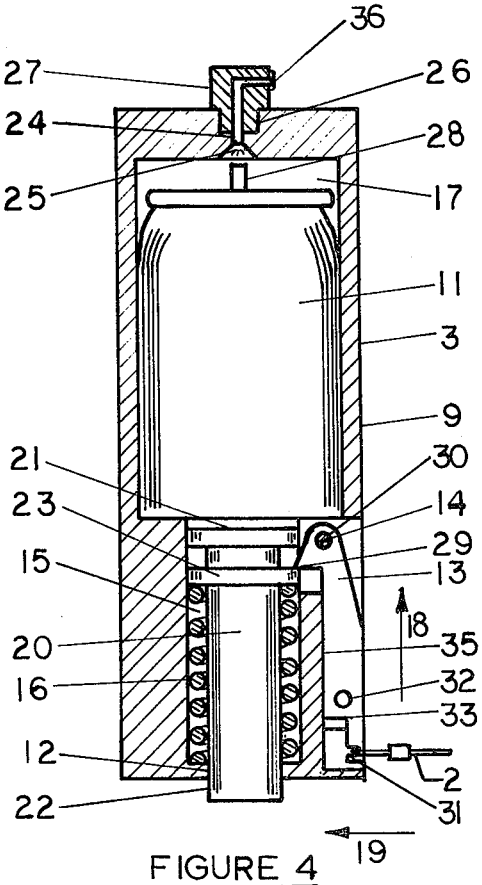
FIG. 4 is a vertical section taken along line B—B of FIG. 3 showing the firing member in its cocked position displaced from the pressurized container.
Figure 5:
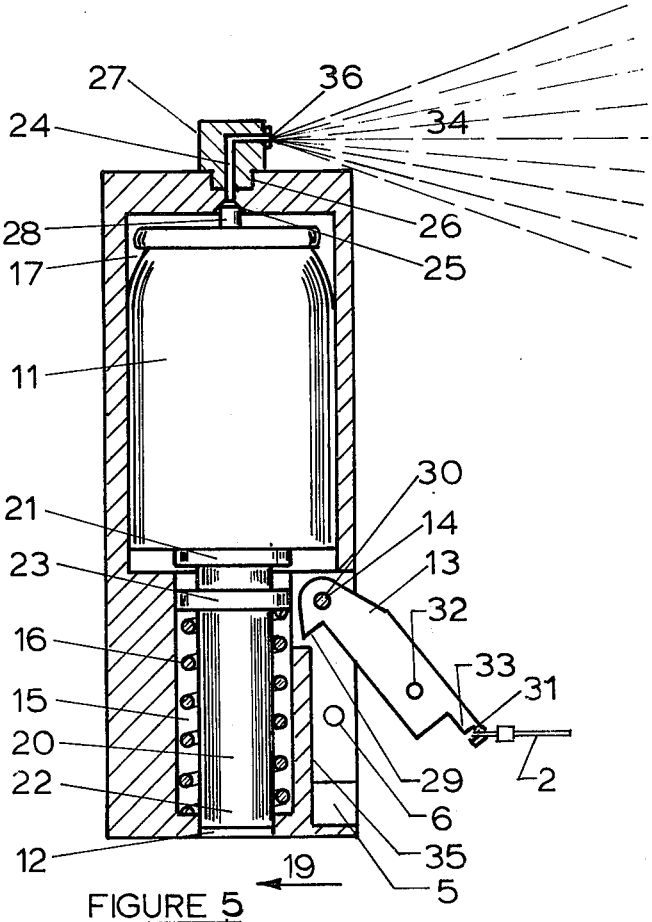
FIG. 5 is a vertical section taken along line B—B of FIG. 3 similar to FIG. 4 but showing the plunger in its release position after the device has been triggered.

The coaxial cylindrical bores 12, 15 and 17, as shown in FIGS. 4 and 5, are formed when the symetrically opposite housing halves 9 and 10 are joined together as shown in FIGS. 3 and 6. The cylindrical bores 12 and 15 slidably mount a cylindrical plunger 20 which is coaxial with bores 12 and 15. The cylindrical plunger 20 forward section 21 which is separated from the top main body section 22 of the plunger by means of an annular flange section 23. The top main body section 22 of the plunger 20 is slidably mounted in bore 12 which is coaxial with bore 15 while the annular flange section 23 is slidably mounted in bore 15.

The cylindrical bore generally designated 17 slidably supports the pressurized container 11 which is slidably confined in proper position. The pressurized container 11 of which one type is sold by Defense Products Manufacturing Corporation, 1628 South Hanley Road, St. Louis, Missouri identified as their "Paralyzer" and another type is sold by Penquin Industries, Inc., Parkesburg, Pa. identified as their "10-4 Chemical Billy" but the invention is not limited to the use of these containers. The pressurized container 11 comprised of a spring urged dispensing spout 28 which when depressed discharges a chemical irritant 34 through the center of the dispensing spout 28.

Now referring to FIGS. 4 and 5; the housing halves 9 and 10 form a restricted fluid passageway 24 having an open entry section 25 for engagment with the dispensing spout 28 of container 11 on one end and a coaxial hole 26 for mounting a rotatable nozzle section 27 on the other end. The fluid passageway 24 and the nozzle section 27 provide means for the chemical irritant to be discharged into and directed from when the dispensing spout 28 of the container 11 is forced into the open entry section 25 by the spring urged plunger 20 acting to move the slidably mounted container 11 in the direction of arrow 18. The conical shape of the open entry section 25 engages the dispensing spout 28, which is made of a relatively soft material and therefore provides an adequate seal at the open entry section 25 to retain fluid flow in the passageway at pressures normally used in the pressurized container.

A coil spring 16 surrounds the main body section 22 of the plunger 20 between the bottom end of the bore 15 and the annular flange section 23 of the plunger 20.

The cylindrical plunger 20, in the position illustrated in FIG. 4, is in its cocked position where the spring 16 is compressed and the open entry section 25 is spaced from the dispensing spout 28 of the pressurized container 11. The cylindrical plunger 20 is releasably restrained in said cocked position by a trigger 13 which is best seen in FIG. 4. The trigger 13 is generally a flat member and includes a latch element 29 and holes 30 and 32 best seen in FIGS. 4 and 5. The trigger 13 is rotatably mounted on pin 14 and slidably mounted in slot 5 formed by the housing halves 9 and 10. The latch element 29 of trigger 13 engages the flanged section 23 of the cylindrical plunger 20. The spring 16 urged cylindrical plunger 20 acting on latch element 29 causes trigger 13 to rotate in the direction of arrow 19 and therefore will be held against the left most end of slot 5 formed by the housing halves 9 and 10, thus retaining the cylindrical plunger 20 in its cocked position.

The plunger 20 may be locked in its cocked position, and the trigger 13 in its set position by means of a safety pin 8. The pin 8 passes through passage 7 in the left housing half 10, a passage 32 in trigger 13, and a passage 6 in the right housing half 9 as shown in FIGS. 4, 5 and 6. All passages are transverse to the longitudinal axis of the plunger 20 and are aligned when plunger 20 is in its cocked position as seen in FIGS. 4, and 6.

A notch 33 is provided near the end 31 of trigger 13. The looped cord 2 is connected at one end to the window sash 1 and at its other end to the trigger 13 by being looped over trigger 13 to engage in notch 33. When it is desired to place the device in condition for firing upon opening of the sash 1, the safety pin 8 is removed from passages 6, 32 and 7. If the window sash 1 is opened by a burglar or other intruder, the cord 2 will rotate the trigger 13 moving the trigger latch element 29 out of engagement from flange section 23 of the cylindrical plunger 20, and permitting the cylindrical plunger 20 to be thrust toward the pressurized cylinder 11 by means of the spring 16 to the position illustrated in FIG. 5. In such position, the open entry section 25 of the passageway 24 of housing halves 9 and 10 depresses the dispensing spout 28 of the pressurized container 11 causing the chemical irritant 34 to be discharged through the passageway 24 then into the area to be protected as shown in FIG. 2.

After the device has been fired in the manner described herein above, the housing halves are separated to replace the pressurized cylinder 11 after recocking the cylindrical plunger 20 and the trigger as shown in FIG. 4.

It is an important feature that the trigger 13 be rotatable in this embodiment and that the trigger element 29 slide freely on the flange section 23 of the cylindrical plunger 20 and, hence, present a surface which will ride smoothly when the trigger 13 is pulled. As a consequence, the trigger 13 may be easily withdrawn from engagement without substantial force. Yet, when the trigger 13 is positioned in engagement with flange section 23 on the cylindrical plunger 20 it serves to positively retain the cylindrical plunger 20 in its cocked position. Hence, sustantially less force is required to trigger the device 3 of the present invention than would be required if the cylindrical plunger 20 were retained in its cocked position by means of a transversely extending trigger, yet, the cylindrical plunger 20 is still safely retained in its cocked position against accidental release by plunger retaining means 8. Another important feature is that the spring 16 be of substantial force so that the cylindrical plunger 20 will depress the dispensing spout 28 sufficiently to cause the chemical irritant 34 to be discharged from the dispensing spout 28 of the pressurized cylinder 11.

Figure 7:
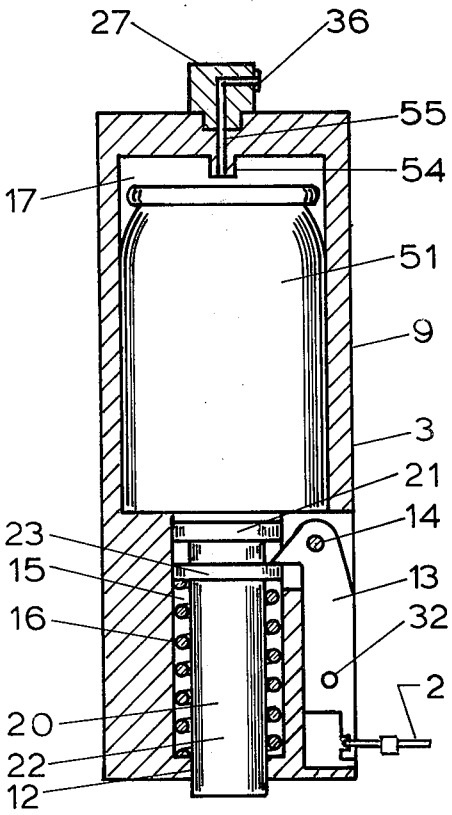
FIG. 7 is a vertical section similar to FIG. 4 but showing a second embodiment of the anti-burglar device containing a pressurized container of the aerosol type but without a projecting spout.

A second embodiment of the invention is illustrated in FIG. 7. In this embodiment the basic structure is as previously described and like numbers are used to indicate like or corresponding parts.

In this embodiment, the pressurized chemical irritant container 11, shown in FIG. 4 having a projecting dispensing spout 28, is replaced with a pressurized chemical irritant container 51, shown in FIG. 7, having a recessed valve. Pressurized containers of the aerosol type with a recessed dispensing valve are well known in the trade. In addition, the conical shape of the open entry section 25 of the fluid passageway 24 of the first embodiment shown in FIG. 4 is replaced with projecting spout 54 depending from housing halves 9 and 10, all of which are shown in FIG. 7.

In this embodiment, all elements function as described in the first embodiment with the following difference. The pressurized container 51 is discharged by the action of the coil spring 16 moving the pressurized container 51 such that the recessed valve of the pressurized container 51 is depressed through engagement with projecting spout 54 and thereby effects discharge.

The chemical irritant is then discharged through the valve of the pressurized container 51, through the open entry section 54 and passageway 55 and out the orifice 36, then into the area to be protected.

Figure 8:
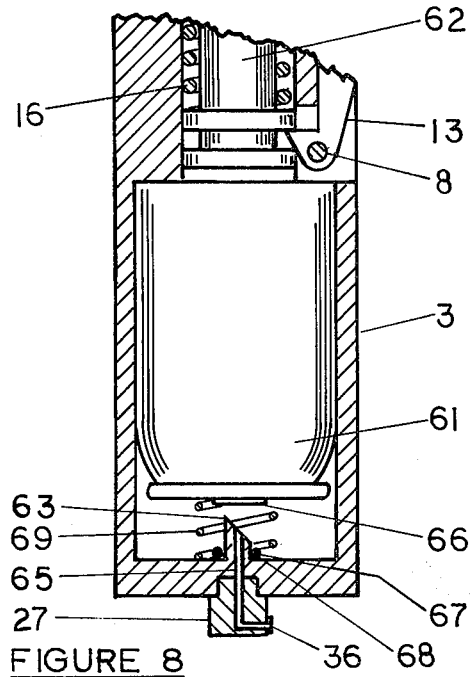
FIG. 8 is a partial vertical section similar to FIG. 4 but showing a third embodiment of the anti-burglar device containing a pressurized container of the type with a sealed end and a means for piercing the seal.

A third embodiment of the invention is illustrated in FIG. 8. In this embodiment the basic structure is as previously described in the first embodiment and like numbers are used to indicate like or corresponding parts.

In this embodiment, the pressurized chemical irritant container 11, shown in FIG. 4 of the first embodiment and having a projecting dispensing spout 28, is replaced with a pressurized chemical irritant container 61 shown in FIG. 8, having a piercable seal. Pressurized containers having piercable seals are well known in the trade. In addition, the conical shaped open entry section 25 of the housing halves 9 and 10 of the first embodiment shown in FIG. 4 is replaced with housing halves 9 and 10 having a projecting section 63 shaped to pierce seal 66 and a means of making a seal capable of withstanding the pressure required for effectively discharging the chemical irritant through the passageway 65 and into the restricted area.

Now referring to FIG. 8, FIG. 8 is an inverted embodiment of FIG. 4 of the first embodiment in which all elements function as described in the first embodiment with the following exceptions. The cylindrical plunger 62 when released by the trigger 13 forces the pressurized container 61 into piercable engagement with the piercing projecting section 63 by the action of a spring 16. As the piercable seal 66 is pierced by the action of the projecting forward section 63 of the housing halves 9 and 10 the cylindrical plunger 62 continues to move the container 61 by the urging of the spring 16 forming a seal by the action of the O-Ring 67 and its retaining seat 68 and the piercable seal 66 of the pressurized container 61. The chemical irritant is then discharged through the pierced seal 66 of the pressurized container 66, through passageway 65, out the orifice 36, and then into the area to be protected.

Figure 9:
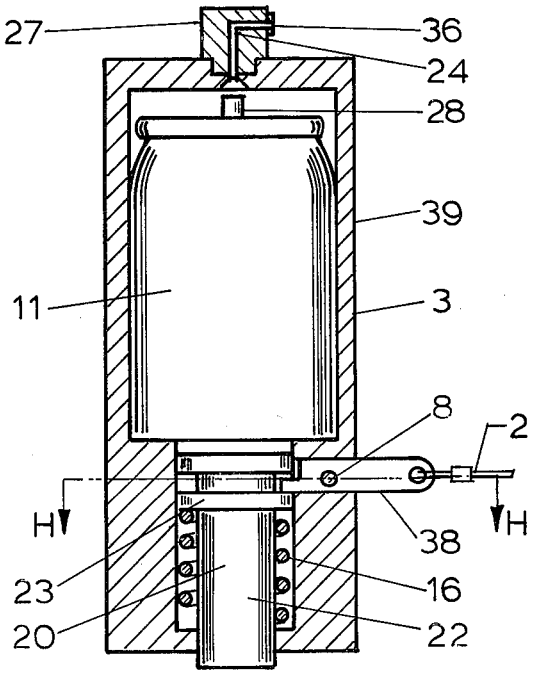
FIG. 9 is a vertical section similar to FIG. 4 but showing a fourth embodiment of the anti-burglary device wherein the trigger is slidably mounted.
Figure 10:
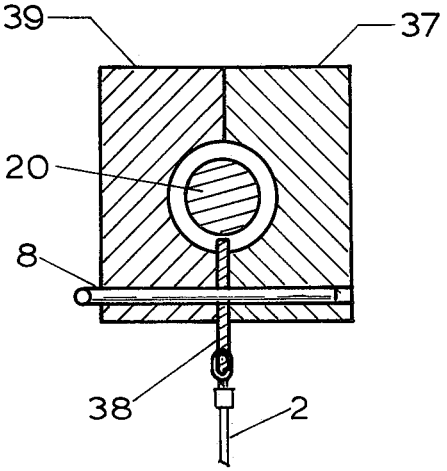
FIG. 10 is a partial horizontal section taken along line H—H of FIG. 9.

The preceeding embodiments of the invention show the chemical dispensing anti-burglary device in its preferred embodiments containing a rotatable trigger but it is recognized that the trigger may be slidably mounted as shown in FIG. 9 and 10.

Therefore a fourth embodiment of the invention is illustrated in FIG. 9 and 10. In this embodiment the basic structure is the same as that previously described in connection with the first embodiment and like numbers are used to indicate like or similar parts.

In this embodiment, the rotatable trigger 13 is replaced with a slidable trigger 38 and housing halves 9 and 10 are replaced with right housing half 37 and left housing half 39 which contain a slot for slidably mounting trigger 38. All elements function as described in the first embodiment except for the following difference. The trigger 38 holds the cylindrical plunger 20 in a cocked position. When the cord 2 is pulled, the trigger 38 releases the cylindrical plunger 20 and causes the pressurized cylinder 11 to discharge. This type of trigger requires more force to release the cylindrical plunger 20 then the rotatable trigger 13 but can be used effectively for many applications.

Figure 13:
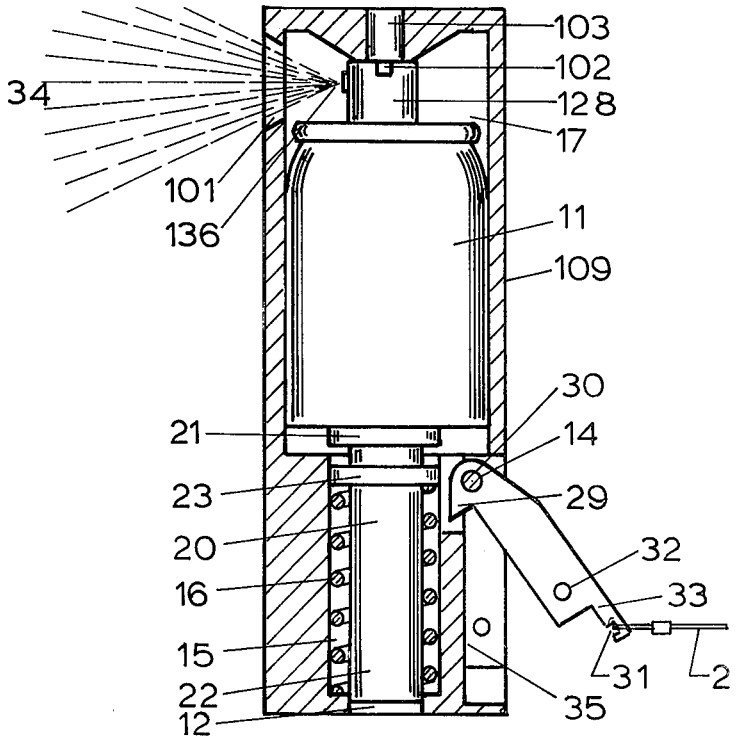
FIG. 13 is a horizontal section taken along line J—J of FIG. 11 but showing the plunger in its released position after the device has been triggered.
Figure 11:
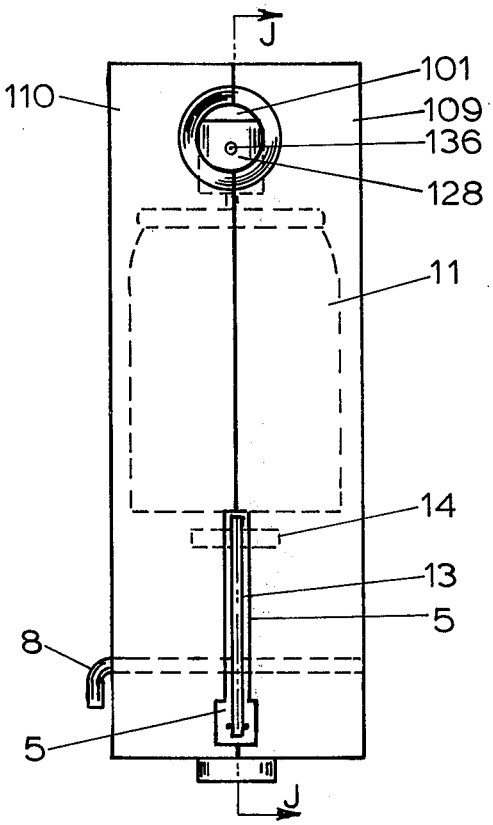
FIG. 11 is a front elevational view similar to FIG. 3 but showing a fifth embodiment of the chemical dispensing anti-burglary device containing a pressurized container of the aerosol type with a projecting dispensing cap.
Figure 12:
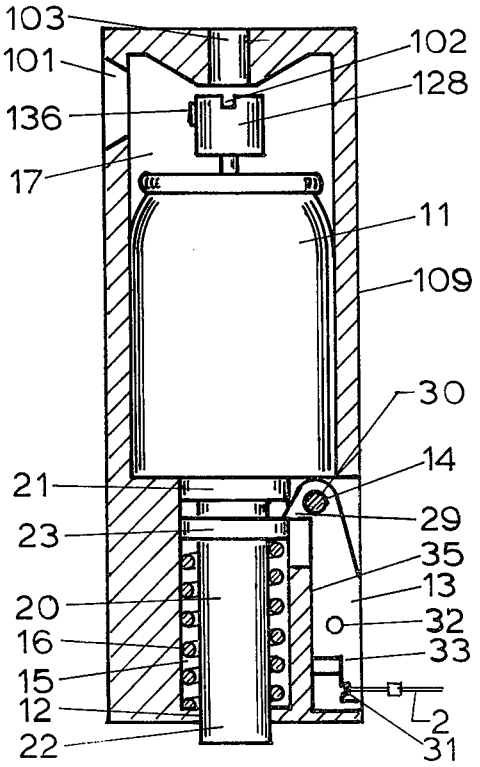
FIG. 12 is a vertical section taken along line J—J of FIG. 11 showing the firing member in a cocked position.

A fifth embodiment of the invention is illustrated in FIGS. 11, 12 and 13. In this embodiment, the structure is as previously described in the first embodiment and like numbers are used to indicate like or corresponding parts.

In this embodiment, the projecting dispensing spout 28 of pressurized chemical irritant container 11, shown in FIG. 4, is replaced with a projecting dispensing cap shown in FIG. 11, 12 and 13. In addition, the fluid passageway 24 and the open entry section 25 are replaced with two aperatures 101 and 103.

Now referring to FIG. 12 and FIG. 13, the trigger element 13 and the plunger 20 operate as before to move the pressurized cylinder 11. In this embodiment the spring 16 urged pressurized cylinder 11 causes the projecting cap 128 to be depressed against the inside top portion of housing halves 109 and 110; thereby causing discharge through aperature 101.

Since it is possible to have several discharge aperatures 101 in communication with the dispensing cap 128; an aperature 103 is provided so that the projecting cap 128 may be rotated to the desired aperature 101 through the use of a screw driver in slot 102.

A sixth embodiment of the invention is illustrated in FIGS. 14–21. In this embodiment the basic structure is the same as that previously described connection with the first embodiment and like numbers are used to indicate like or corresponding parts.

Figure 17:
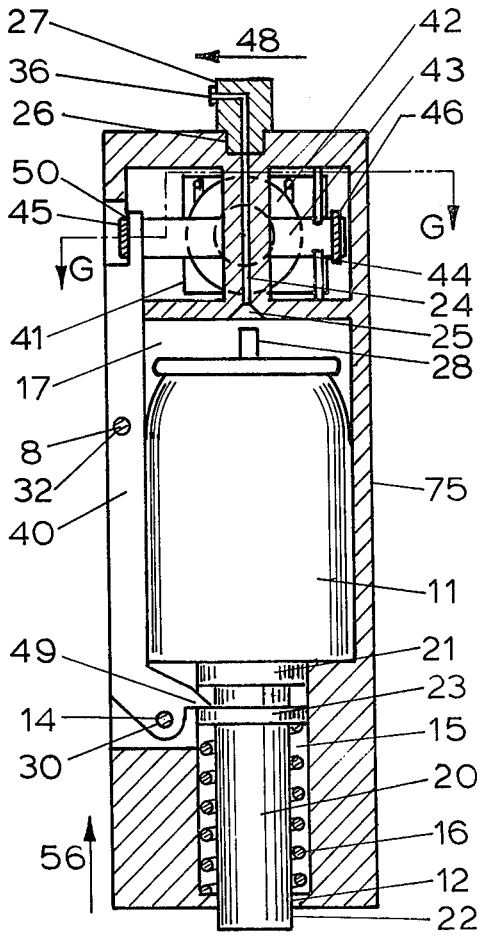
FIG. 17 is a vertical section taken along line D—D of FIG. 16 showing the firing member in a cocked position.
Figure 21:
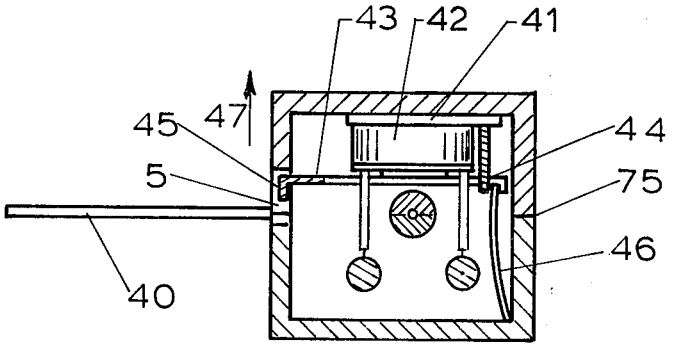
FIG. 21 is a partial horizontal sectional of the anti-burglary device in its discharging position.
Figure 18:
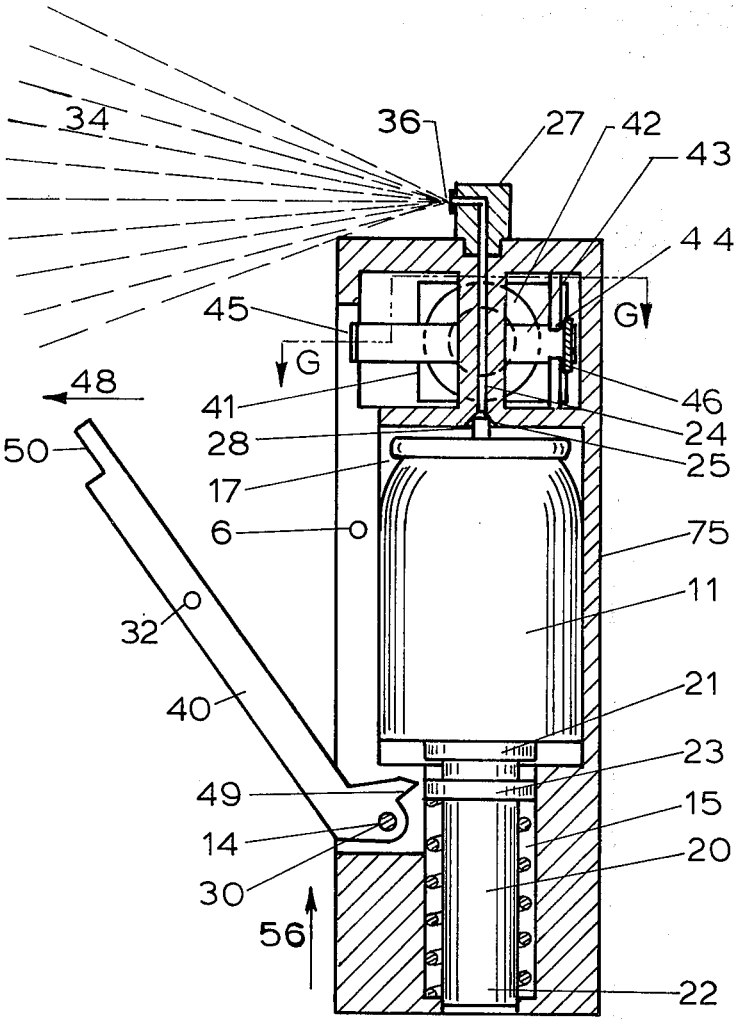
FIG. 18 is a vertical section taken along line D—D of FIG. 16 similar to FIG. 17 but showing the plunger in its release position after the device has been triggered.
Figure 25:
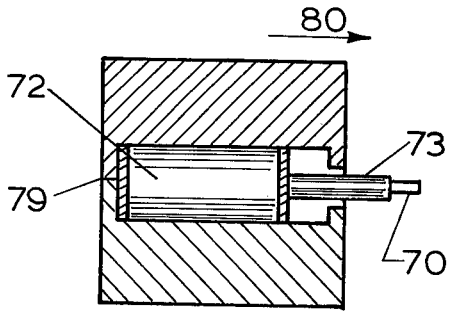
FIG. 25 is a horizontal section taken along line E—E of FIG. 23 similar to FIG. 24 but showing the electromechanical actuator in its release position.
Figure 24:
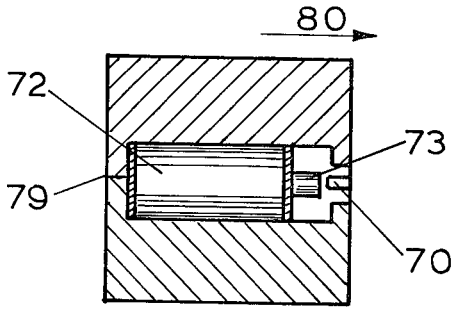
FIG. 24 is a horizontal section taken along line E—E of FIG. 23 showing the electromechanical actuator in its actuation position.
Figure 22:
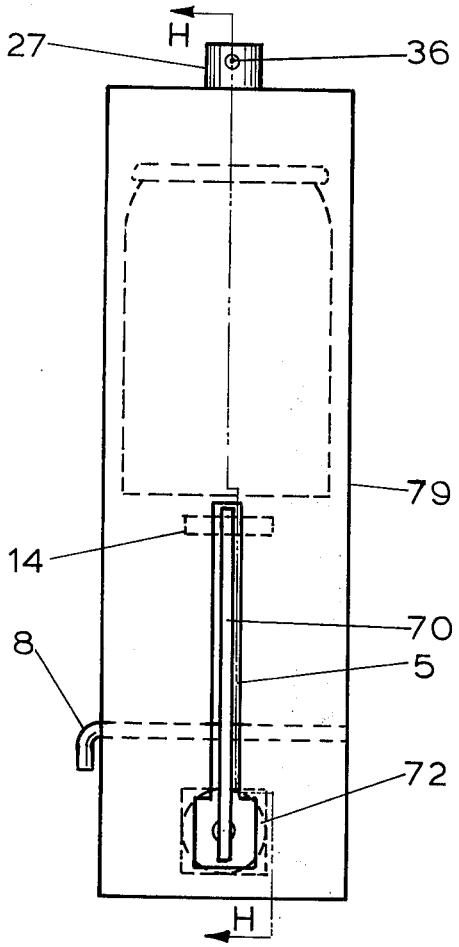
FIG. 22 is a front elevational view similar to FIG. 3 but showing a seventh embodiment of the anti-burglary device containing a pressurized container of the aerosol type with a projecting spout for positive release by electromechanical operation.
Figure 23:
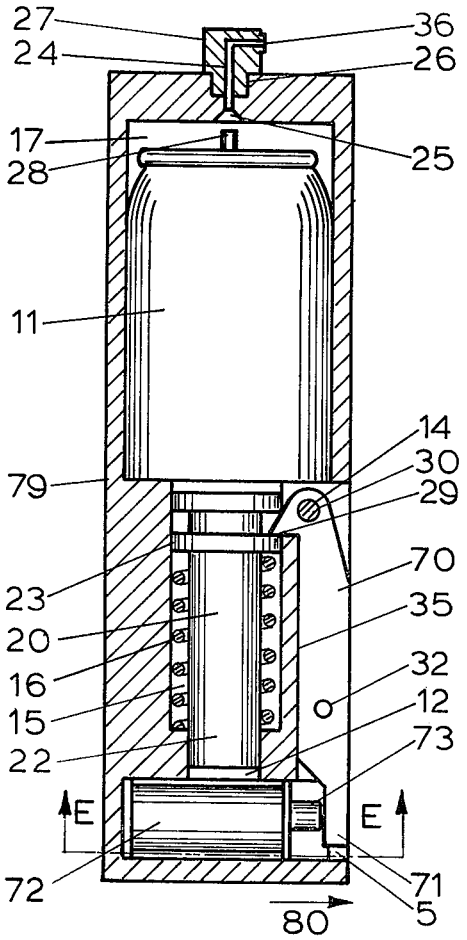
FIG. 23 is a vertical section taken along line H—H of FIG. 22 showing the firing member in a cocked position.

In the anti-burglar device 3 previously described, the trigger 13 is released when cord 2 is pulled. The trigger 13 holds the cylindrical plunger 20 in a cocked position. In this embodiment, the trigger 13 is replaced by a latching-release lever 40 as best seen in FIGS. 17 and 18 wherein the latching-release lever 40 will be forced to rotate in the direction of arrow 48 by the action of the annular flange section 23 of the spring 16 urged cylindrical plunger 20. The operation of this latching-release lever 40 will become apparent in the following description.

Figure 14:
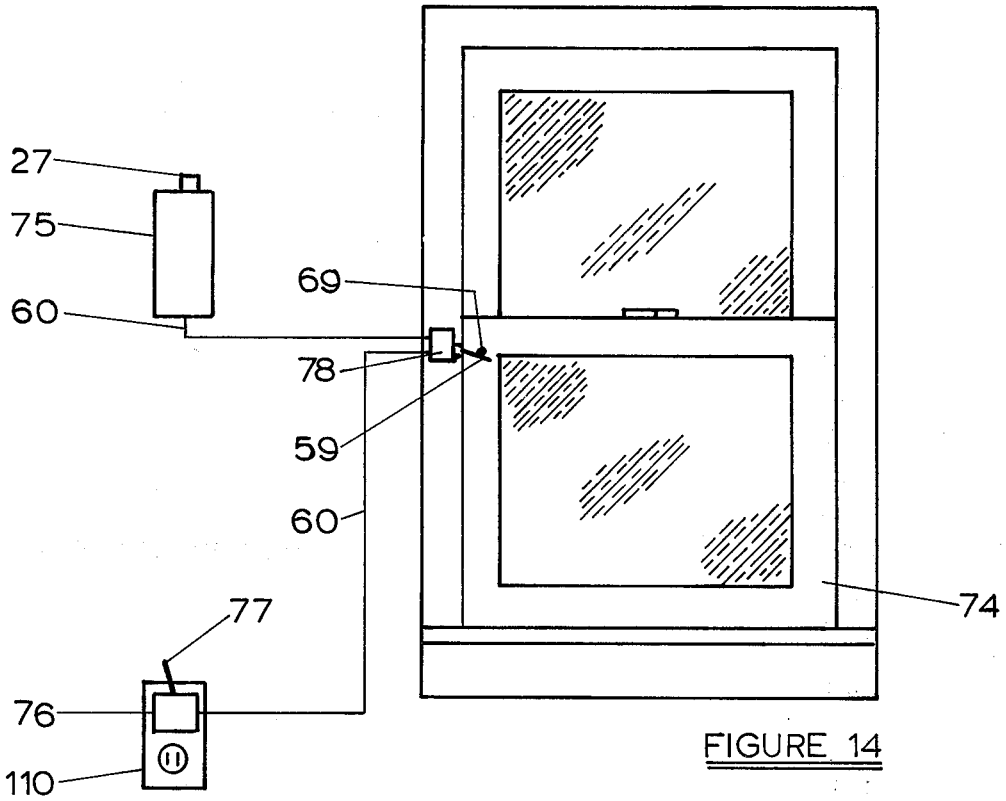
FIG. 14 is an elevational view of a wall of a room having the sixth embodiment of the chemical dispensing anti-burglary device of the present invention secured to a wall and electrically connected to a switch at the window.
Figure 15:
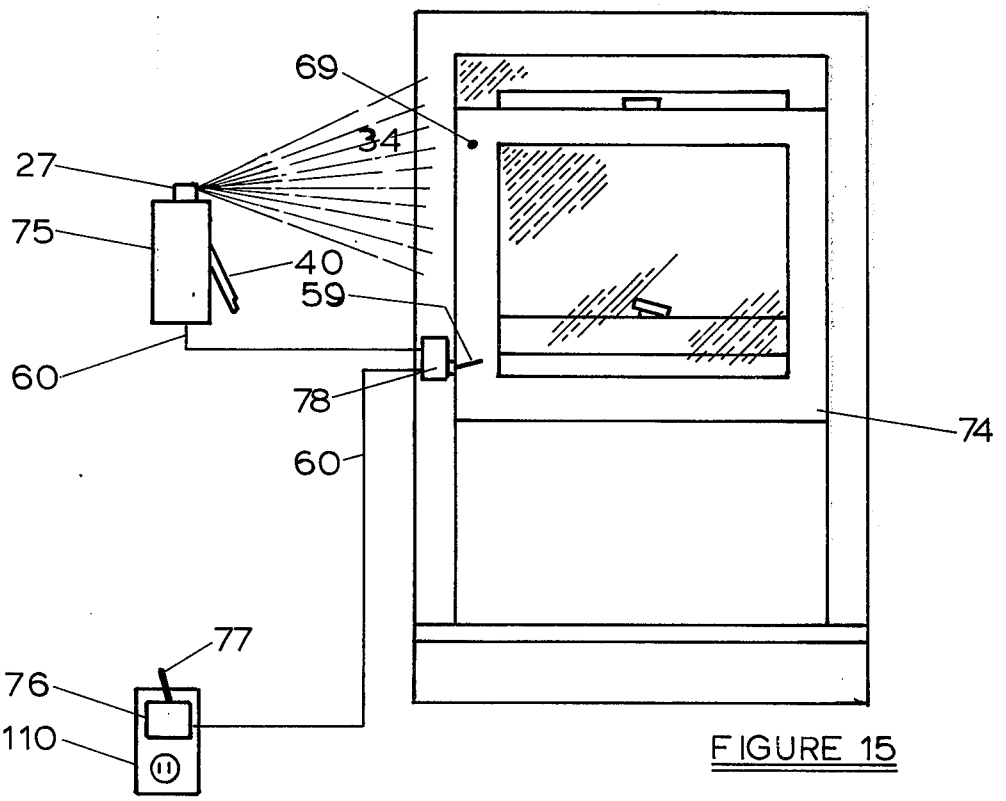
FIG. 15 is an elevational view similar to FIG. 14 but showing the window open and showing the device discharging.
Figure 20:
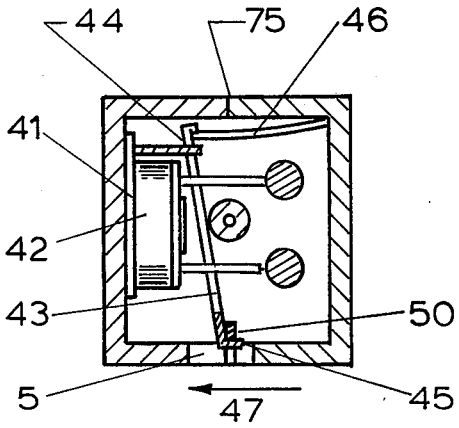
FIG. 20 is a partial horizontal sectional showing the electromechanical actuator of the anti-burglar device wherein the trigger element is electromechanically controlled.

As shown in FIG. 14 and 15, the device 75 can be remotely mounted from a window or other object or entryway to be protected and connected by means of an electrical cable 60 to an electrical switch 78; an on-off switch 77 and a power source 76, so that upon opening the window sash 74 by an unauthorized person, the contacts of switch 78 will close as a result of switch activation pin 69 releasing contact lever 59 of switch 78 electromechanically causing the device 75 to discharge a chemical irritant 34 into the area to be protected. This embodiment of the device includes all of the components previously described except for the change in the method of triggering previously described and an addition of an electromechanical actuator 41.

Now referring to FIGS. 16–21, an electromechanical actuator 41 is shown. The electromechanical actuator 41 comprises an electromagnetic coil 42, a solenoid latch lever 43, a lever pivot point 44 and a latch lever spring 46. The components of the electromechanical actuator 41 are arranged in a manner that when power is applied to the electromagnetic coil 42, a magnetic flux is generated, causing the latch lever 43 to be attracted toward the coil 42 and to rotate around pivot point 44. The rotation of the latch lever 43 will be restrained from further movement by the electromagnet coil 42. The latch lever 43 is held in a normal rest position by the action of spring 46 exerting force on the latch lever 43 in direction opposite that indicated by the arrow 47. This causes the catch 45 of latch lever 43 to move in the same direction and causes the latch lever 43 to rest against the latching-release lever 40 and prevent the latching-release lever 40 from rotating in the direction 48.

As can be best seen in FIG. 17, the annular flange section 23 of the spring 16 urged cylindrical plunger 20 engages with the latch portion 49 of the latching-release lever 40 and will cause the latching-release lever 40 to rotate in the direction of arrow 48 about pivot pin 14. The latching-release lever 40 is releasably restrained from rotating by the catch 45 of the latch lever 43 which is restrained from transverse movement by the pivot point 44.

When switch 78 is closed, electric power is applied to the electromagnetic coil 42, thus, energizing the electromagnetic coil 42. The solenoid latch lever 43 is pulled toward the electromagnetic coil 42 in direction 47 around pivot point 44 thereby moving the latch lever catch 45 away from engagement with the latching release lever 40 at notch 50; whereupon the annular flange section 23 of the spring 16 urged cylindrical plunger 20 engaging with the latch portion 49 of the latching-release lever 40 causes the latching-release lever 40 to rotate in the direction of arrow 48. This permits the cylindrical plunger 20 urged by the action of spring 16 to be moved in the direction of arrow 56 until the projecting dispensing spout 28 of the pressurized container 11 is in seated engagement with the open entry section 25; further movement of the cylindrical plunger 20 will depress the projecting spout 28 and cause the chemical irritant 34 to be released from the pressurized container 11, through the dispensing spout 28, the open entry section 25, the fluid passageway 24 and the orifice 36.

It is an important feature that the latching-release lever 40 be rotatable and that the catch 45 of the latch lever 43 slide freely on the notch 50 of the latching-release lever 40, whereby a consistent release of the latch lever 43 may be obtained on a limited use electric power. Yet the latching-release lever 40 is positioned in its cocked position in engagement with the latch lever 43, the spring 16 urged cylindrical plunger 20 is securely held in a cocked position safe against accidental release.

Figure 19:
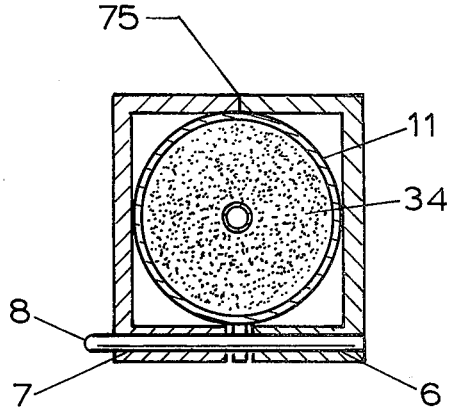
FIG. 19 is a horizontal section taken along line C—C of FIG. 16 with the lever cocked and locked by the safety pin.
Figure 16:
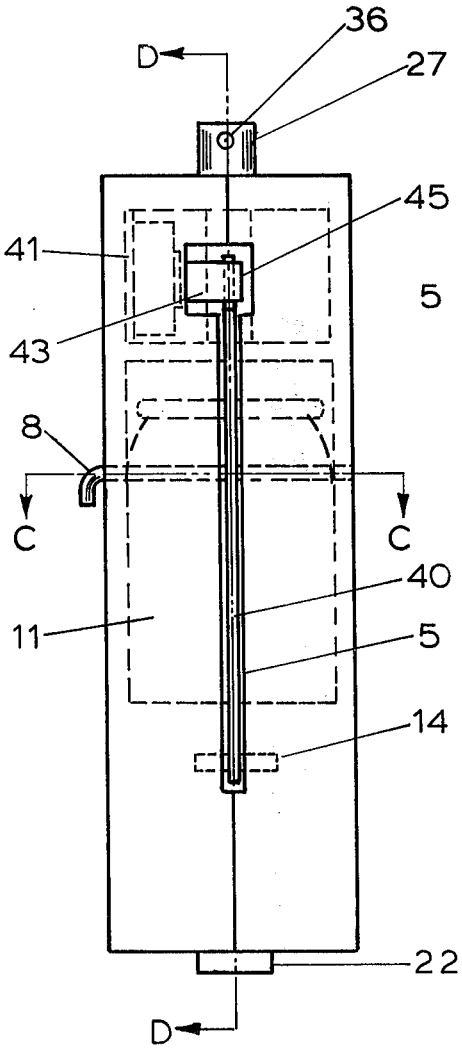
FIG. 16 is a front elevational view similar to FIG. 3 but showing a sixth embodiment of the anti-burglar device containing a pressurized container of the aerosol type with a projecting spout for electromechanical operation.

With the latching-release lever 40 in the cocked position shown in FIG. 19, the safety pin 8 may be inserted in holes 6 and 7 to safely lock the latching-release lever 40 from accidental discharge.

A seventh embodiment of the invention is illustrated in FIGS. 22–25. In this embodiment the basic structure is the same as that previously described in connection with the first embodiment and like numbers are used to indicate like or corresponding parts.

In this embodiment, the trigger 13 is replaced by a trigger 70 wherein the notch 33 of trigger 13 is replaced by an extension 71. In addition, the device 79 is equipped with an electromechanical actuator 72 of the solenoid push type in which the solenoid plunger 73 is mounted to engage the extension 71 of trigger 70.

The device 79 is installed in the manner described in the sixth embodiment and shown in FIGS. 14 and 15 wherein the device 75 is replaced by device 79. As the window 74 is raised; the solenoid coil is energized and the plunger 73 moves in the direction 80, pushing on extension 71 of trigger 70. This releases the cylindrical plunger 20 previously described and discharges the device.

Figure 28:
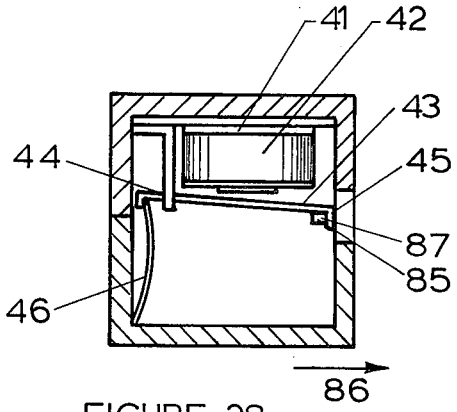
FIG. 28 is a horizontal section taken along line F—F of FIG. 27 showing the electromechanical actuator latching the trigger element in an actuation position.
Figure 26:
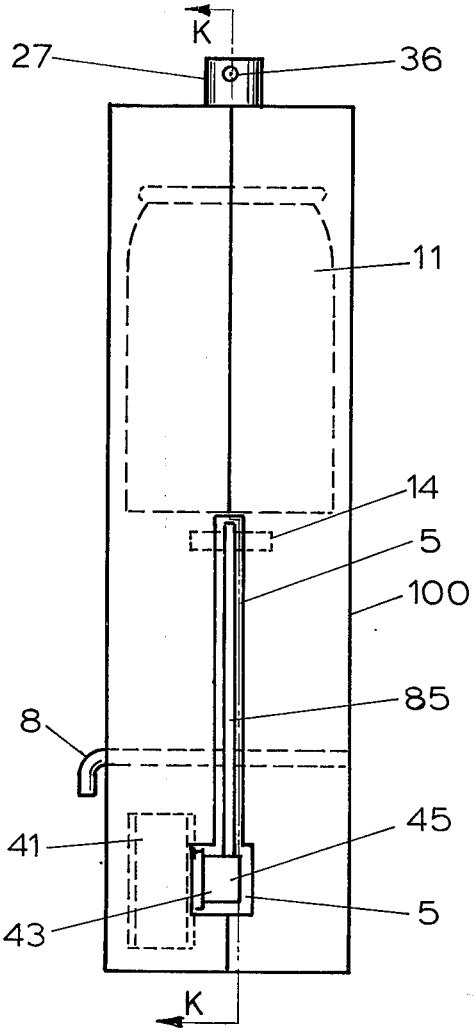
FIG. 26 is a front elevational view similar to FIG. 3 but showing an eighth embodiment of the anti-burglar device containing a pressurized container of the aerosol type with a projecting spout for electromechanical cammed release of trigger element.
Figure 27:
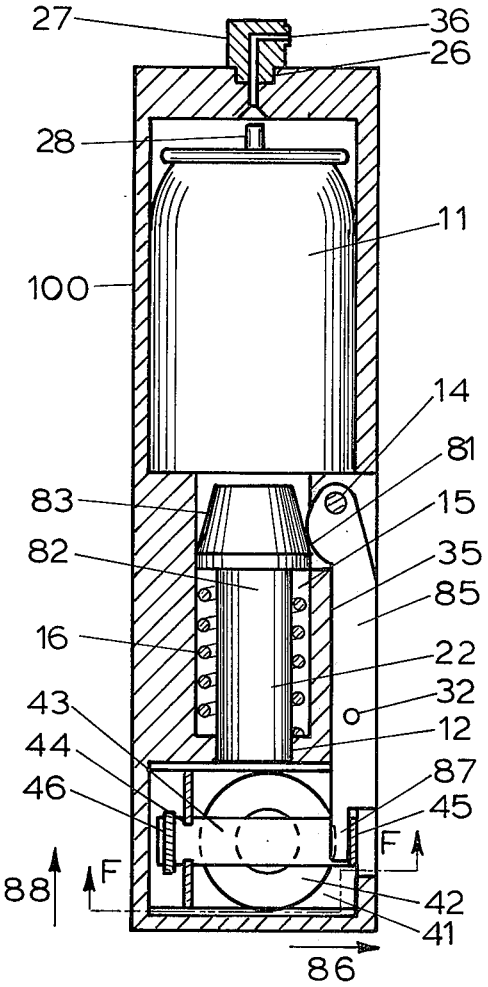
FIG. 27 is a vertical section taken along line K—K of FIG. 26 showing the firing member in a cocked position.

An eighth embodiment of the invention is illustrated in FIGS. 26–28. In this embodiment, the structure is the same as that previously described in connection with the sixth embodiment and like numbers are used to indicate like or corresponding parts.

In this embodiment, the annular flange section 23 of the cylindrical plunger 20 is replaced with a cylindrical plunger 82 containing a beveled surface 83 on its annular flange section; and the trigger catch 49 of trigger 40 is replaced by a beveled section 81 of a latching-release lever 85. This device is indicated by reference character 100.

In this embodiment, an electromechanical actuator 41 is installed and operates in a like manner as described in the sixth embodiment. The spring 16 urged cylindrical plunger 82 acting through the beveled flange section 83 and acting cammed engagement with the beveled surface 81 of latching-release lever 85 will rotate the latching-release lever in the direction 86. The catch 45 of latch lever 43 of the electromechanical actuator 41 will hold the latching release lever 85 in releasable engagement until the electromechanical actuator 41 is electrically energized thus causing discharge.

Figure 31:
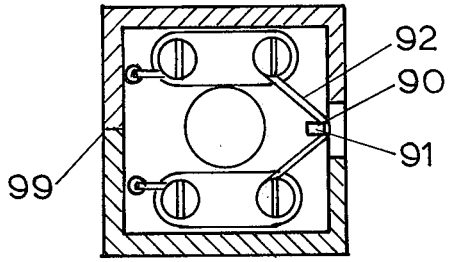
FIG. 31 is a horizontal section taken along line M—M of FIG. 30 showing the fusible link holding the trigger element in its actuation position.
Figure 29:
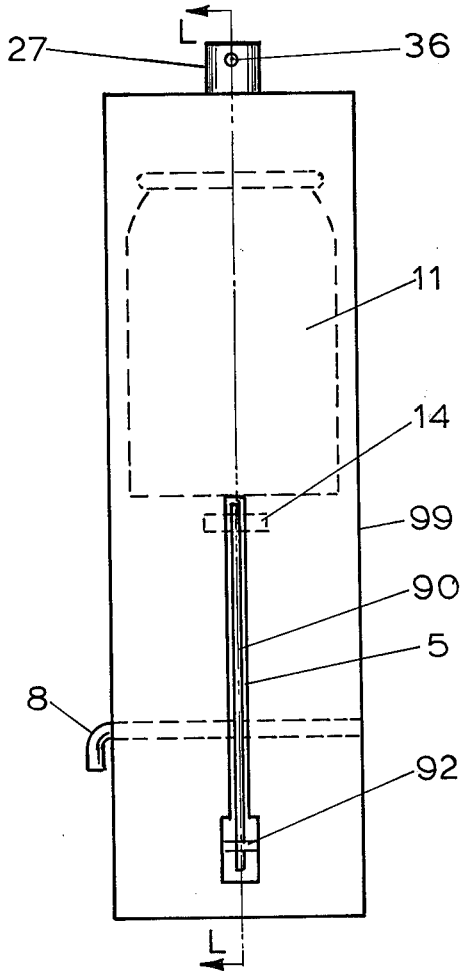
FIG. 29 is a front elevational view similar to FIG. 3 but showing a ninth embodiment of the anti-burglar device containing a pressurized container of the aerosol type with a projecting spout wherein the trigger element is held in the actuation position with a fusible link.
Figure 30:
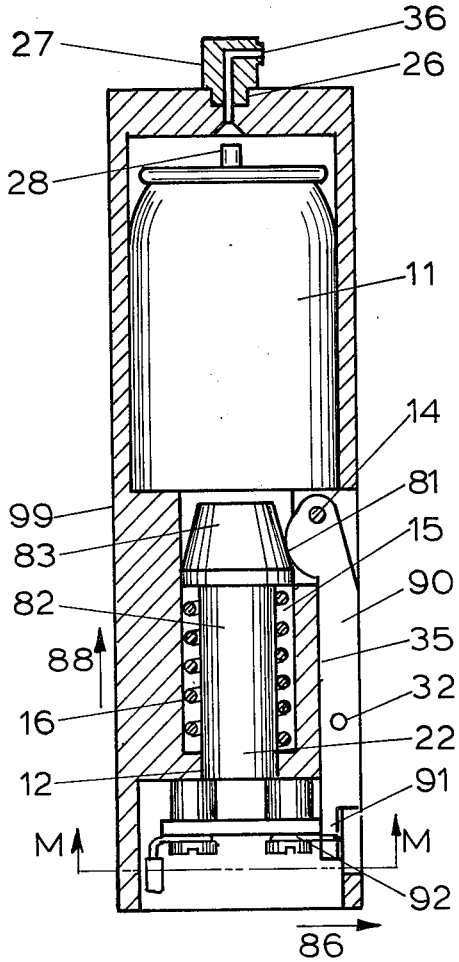
FIG. 30 is a vertical section taken along line L—L of FIG. 29 showing the firing member in its cocked position.

A ninth embodiment of the invention is illustrated in FIGS. 29–31. In this embodiment, the basic structure is the same as that described in connection with the eighth embodiment and like numbers are used to indicate like or corresponding parts. The chemical dispensing anti-burglary device of this embodiment is indicated by reference character 99.

In this embodiment, the releasably retaining means acting on the latching-release lever 92, is a fusible link 90 which replaces the electromechanical actuator 41 of the sixth embodiment. The fusible link 92 will safely retain the latching-release lever 90 from rotation until an electric current is passed through the fusible link 40 in a manner previously described causing fusible link 92 to melt and release the latching-release lever 90 which causes discharge. The fusible link 92 shown in FIGS. 29–31 may also replace the electromechanical actuator 41 in the sixth embodiment shown in FIGS. 16–21.

Figure 32:
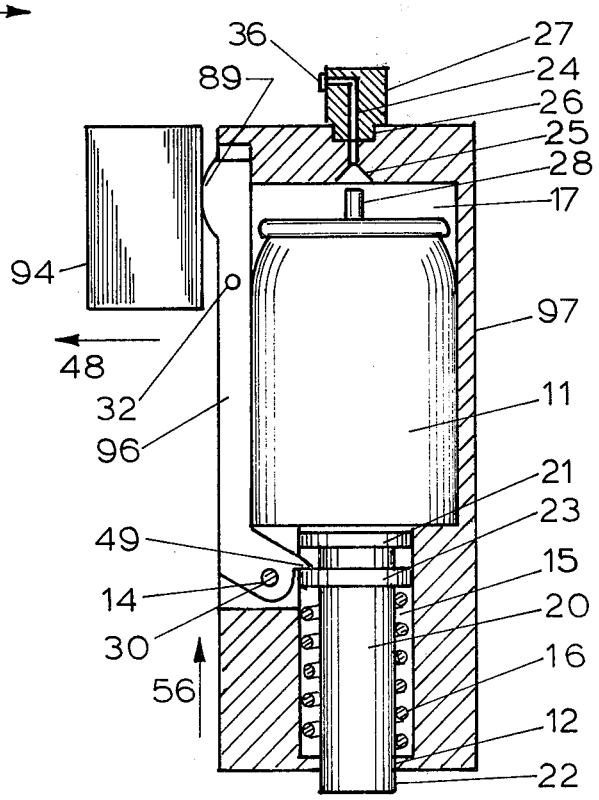
FIG. 32 is a vertical section similar to FIG. 17 wherein the trigger element is held in shouldered engagement with the firing member by a movable object therey retaining trigger element in its actuation position.

A tenth embodiment of the invention is shown in FIG. 32. In the embodiment, the basic structure is the same as that described in the sixth embodiment and like numbers are used to indicate like or corresponding parts. The chemical dispensing anti-burglary device of this embodiment is indicated by reference character 97.

In this embodiment, the releasable retaining means acting on the latching release lever 96 is a movable object which replaces the electromechanical actuator of the sixth embodiment. Any movable object such as a window, door, TV set, Hi Fi set etc. can be mounted to retain the release lever 96. If it is desired to move the protected object: the safety pin 8, previously described, is inserted in a manner to engage hole 32 thus safely deactivating the device. However, if properly installed, the intruder will not notice device 97 and move the protected object and cause discharge.

Figure 33:
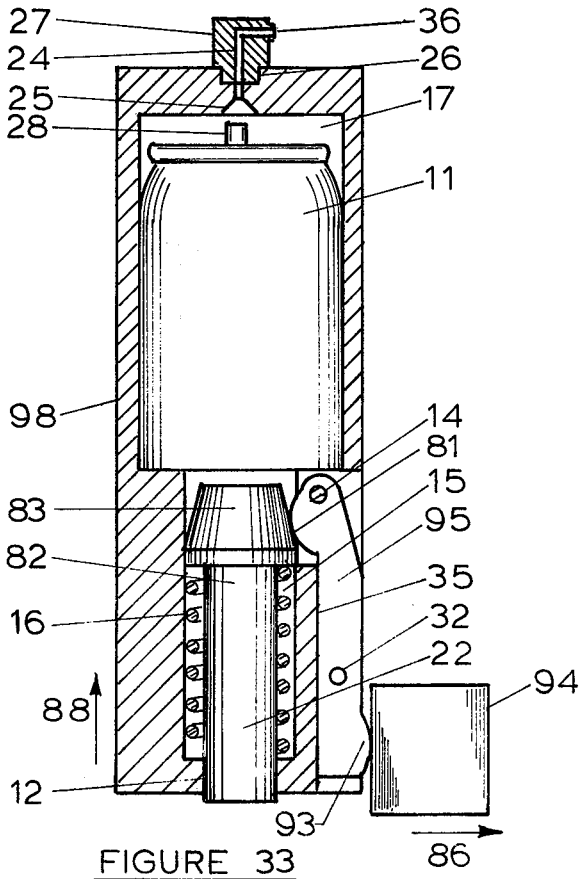
FIG. 33 is a vertical section similar to FIG. 27 wherein the trigger element is held in cammed engagement with the firing member by a movable object thereby retaining the trigger element in its actuation position.

An eleventh embodiment of the invention is shown in FIG. 33. In this embodiment, the basic structure is the same as that described in connection with the eighth embodiment and like numbers are used to indicate like or corresponding parts. The chemical dispensing anti-burglary device of this embodiment is by reference character 98. This embodiment is installed in a manner similar to that described in the tenth embodiment.

The chemical dispensing anti-burglary device described herein in several embodiments was generally shown with a pressurized container 11 with a projecting dispensing spout 28 mounted to discharge into a funnel like open entry section 25 of a fluid passageway 24 when the device is discharged. Alternately the devices 75, 79, 97, 98, 99 and 100 will also function with a pressurized container of the aerosol type with a recessed valve by providing a tubular member depending from the housing to cause discharge; in addition the devices can be used with a sealed pressurized container with a piercable seal; also the aerosol type container with a dispensing projecting cap wherein the cylindrical plunger causes the projecting cap to cause discharge; through movement but the invention is not limited to these type of containers.

Although I have herein shown and described the invention in what I have conceived to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. A chemical dispensing anti-burglary device for use with a pressurized container, the device comprising: a body member; means for slideably supporting said pressurized container in said body member; a fluid passageway extending through said body member having an open entry section; means for causing the discharge of fluid from said pressurized container into said open entry section of said fluid passageway; a spring biased firing member supported in said body member and arranged to discharge fluid from said pressurized container upon movement of said slidably supported pressurized container when said firing member is released; means for releasably retaining said firing member in a cocked position; said retaining means including a trigger element; said trigger element being mounted for movement between an actuation position and a release position; said trigger element when in said actuation position being in engagement with surface of said firing member to retain said firing member in said cocked position; and said trigger element in said release position allowing said firing member to activate said discharging means through movement of said pressurized container.

2. The invention of claim 1 wherein said pressurized container includes a dispensing valve actuated to permit fluid discharge therethrough upon depression thereof, said valve being activated to said release position through movement of said spring biased firing member acting to move said slideably mounted pressurized container to cause depression of said valve, thus causing discharge.

3. The chemical dispensing anti-burglar device of claim 2, wherein said valve pressurized container contains a projecting dispensing spout, said dispensing spout discharging fluid upon depression thereof, said open entry section being funnel shaped for receiving said projecting dispensing spout on said container.

4. The chemical dispensing anti-burglar device of claim 2 wherein said valve pressurized container includes a recessed valve, said body member includes a projection in said open entry section extending beyond said open entry section toward said container to engage said recessed valve, said recessed valve activated upon depression thereof to emit fluid.

5. The chemical dispensing anti-burglar device of claim 2 wherein said valve pressurized container contains a projecting dispensing cap activated to permit fluid discharge therethrough upon depression thereof, means for restricting movement of said projecting dispensing cap by said body member, an aperture in said body member in communication with said cap, said slideably supported pressurized container arranged to activate said dispensing cap thereby discharging said pressurized container through said cap and aperture when said firing member is released.

6. The chemical dispensing anti-burglar device of claim 1 in which the pressurized container comprises a pierceable section, means to provide a seal between said pierceable section and said open entry section, and means for puncturing said pierceable section, whereby fluid may be discharged.

7. The chemical dispensing anti-burglar device of claim 6 in which said means for puncturing comprises a projecting spout depending from said body member.

8. The chemical dispensing anti-burglar device of claim 1 wherein said trigger element is mounted for rotation between said actuation position and said release position.

9. The chemical dispensing anti-burglar device of claim 1 wherein said trigger element is mounted for sliding movement between said actuation position and said release position.

10. The chemical dispensing anti-burglar device of claim 1 wherein said trigger element when in said actuation position is in shouldered engagement with said firing member to retain said firing member in a cocked position.

11. The anti-burglar chemical dispensing device of claim 10 and a means for electromechanically retaining and releasing said trigger element.

12. The anti-burglar chemical dispensing device of claim 11 wherein said electromechanical retaining-releasing means of said trigger element comprises a solenoid latch lever for holding said trigger element in said actuation position, said solenoid lever being resiliently held in engagement with said trigger element to retain said firing member in said cocked position and a magnetic cored coil for moving said solenoid lever out of engagement with said trigger element whereby said trigger element moves to said release position.

13. The chemical dispensing anti-burglar device of claim 1 wherein said trigger element in said actuation position is in cammed engagement with a shaped surface of said firing member, said cammed engagement arranged to move said trigger element from said actuation position to said release position, means for holding said trigger element in engagement with said firing member, said holding means mounted for movement between holding position and a release position, said holding means in said holding position securing said trigger element in engagement with surface of said firing member, said holding means in said release position permitting trigger element to move to its release position.

14. The chemical dispensing anti-burglar device of claim 1 wherein there is a means for moving said trigger element from said actuation position to said release position, said trigger moving means including a means for attaching a cord to said trigger element, said cord arranged to cause movement of said trigger.

15. The anti-burglar chemical dispensing device of claim 1 wherein there is means for retaining said trigger element in said actuation position, said retaining means comprising of a fusible link mounted in engagement with said trigger element to retain said trigger element in a cocked position, said fusible link to release said trigger element when an electric current is passed through said fusible link.

16. The anti-burglar chemical dispensing device of claim 1 wherein there is a means for moving said trigger element from said actuation position to said release position, said trigger element moving means comprising of a solenoid containing an electromagnetic coil and a plunger, said electromagnetic coil and plunger being mounted to cause release of said trigger element when said electromagnetic coil is electrically energized.

17. The anti-burglar device of claim 1 wherein th is a means to safely retain said trigger element, said retaining means including a pin, said pin being mounted for an insertion position and a removable position, said pin in said insertion position being mounted through a hole in said body member in a manner to prevent movement of said trigger element, said removable position having pin removed permitting movement of said trigger element when actuated.

* * * * *